US006272889B1

(12) United States Patent
Burleigh et al.

(10) Patent No.: US 6,272,889 B1
(45) Date of Patent: Aug. 14, 2001

(54) PUSHBUTTON LOCK

(75) Inventors: Charles E. Burleigh; Wayne F. Larson, both of Salem, OR (US)

(73) Assignee: Interlogix, Inc., Salem, OR (US)

( * ) Notice: Subject to any disclaimer, the term of this patent is extended or adjusted under 35 U.S.C. 154(b) by 0 days.

(21) Appl. No.: 09/689,224

(22) Filed: Oct. 11, 2000

Related U.S. Application Data

(62) Division of application No. 09/164,403, filed on Sep. 30, 1998, now Pat. No. 6,145,355.

(60) Provisional application No. 60/072,210, filed on Jan. 22, 1998.

(51) Int. Cl.[7] ..... E05B 37/16

(52) U.S. Cl. ..... 70/297; 70/214

(58) Field of Search ..... 70/297–299, 333 R, 70/214

(56) References Cited

U.S. PATENT DOCUMENTS

| | | | |
|---|---|---|---|
| 1,019,136 | 3/1912 | Dodge | 70/299 |
| 1,368,556 | 2/1921 | Hill | 70/54 |
| 1,374,769 | 4/1921 | Schicke | 70/299 |
| 1,423,691 | 7/1922 | Sokolov | 70/299 |
| 1,500,656 | 7/1924 | Stolberg | 70/299 |
| 2,549,882 | 4/1951 | Berger | 70/299 |
| 2,566,967 | 9/1951 | Soler Capdevila | 70/299 |
| 2,706,393 | 4/1955 | Jamieson et al. | 70/299 |
| 3,187,528 | 6/1965 | Check | 70/299 |
| 3,274,810 | 9/1966 | Traversa et al. | 70/299 |
| 3,910,078 | 10/1975 | Schulz | 70/299 |
| 4,274,272 | 6/1981 | Wang et al. | 70/299 |
| 4,626,007 | 12/1986 | LArson | 292/63 |
| 4,748,833 | 6/1988 | Nagasawa | 70/298 |
| 4,936,894 | 6/1990 | Larson et al. | 70/298 |
| 5,720,193 | 2/1998 | Dick | 70/298 |
| 5,768,921 | 6/1998 | Hill | 70/63 |

FOREIGN PATENT DOCUMENTS

| | | |
|---|---|---|
| 2148379A | 5/1985 | (GB) . |
| 2176233A | 12/1986 | (GB) . |
| 2290106A | 12/1995 | (GB) . |
| WO 82/02571 | 8/1982 | (WO) . |

*Primary Examiner*—Lynne H. Browne
*Assistant Examiner*—John B. Walsh
(74) *Attorney, Agent, or Firm*—Klarquist Sparkman Campbell Leigh & Whinston, LLP

(57) ABSTRACT

Various enhancements are provided to a pushbutton lock to enhance its security. One is the provision of button tips that are mounted on the ends of the button assemblies and spring-loaded to protrude from the face of the lock, regardless of whether the underlying button is "in" or "out." By this arrangement, a bystander cannot readily see the button combination by the pattern of depressed buttons. This arrangement also reduces tactile feedback between the underlying button assembly and the externally available button tips, increasing resistance to pick attacks. A further enhancement is the provision of button bars between adjacent pairs of button tips. Whenever any of the button tips is manually depressed, the corresponding button bar is pressed into engagement with, and prevents movement of, a member that must be moved in order to unlock the lock. This arrangement further increases lock security by preventing an attacker from experimentally pressing buttons and judging the tactile effect thereon in attempted unlockings of the lock.

10 Claims, 2 Drawing Sheets

FIG. 1
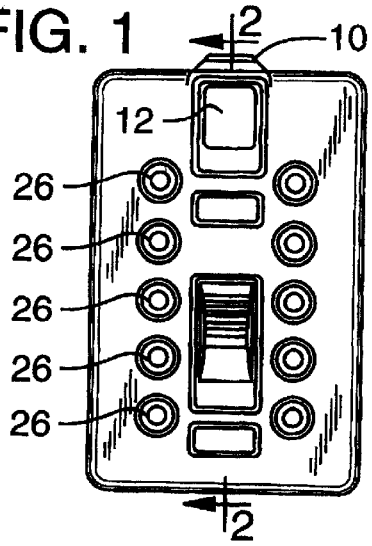
FIG. 1A
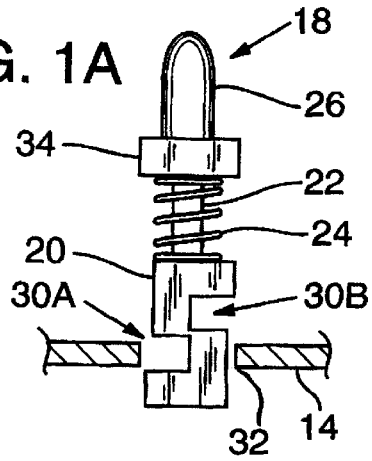
FIG. 2
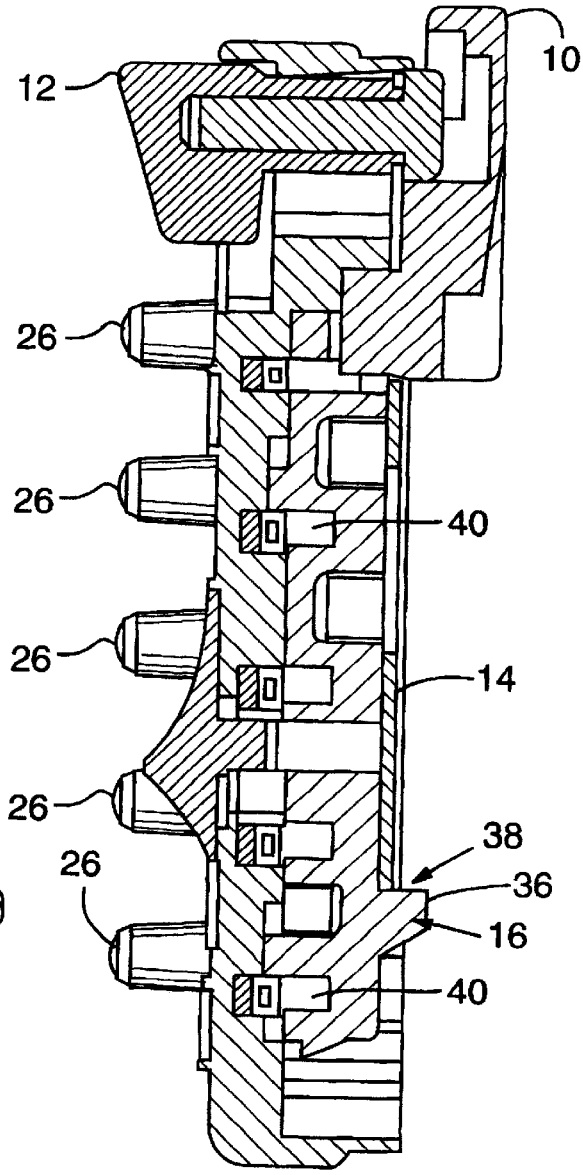
FIG. 3
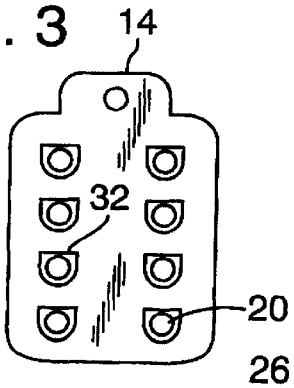
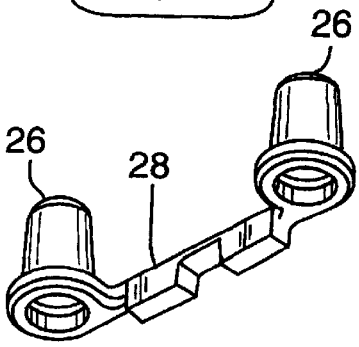
FIG. 4A
FIG. 4B
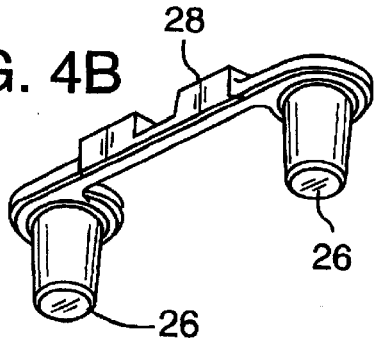

PUSHBUTTON LOCK

RELATED APPLICATION DATA

This application is a divisional of Ser. No. 09/164,403, filed Sep. 30, 1998 now U.S. Pat. No. 6,145,355, which claims the benefit of Provisional Application No. 60/072, 210, filed Jan. 22, 1998.

FIELD OF THE INVENTION

The present invention relates to improvements to pushbutton locks to render same more secure.

BACKGROUND AND SUMMARY OF THE INVENTION

Pushbutton locks are well known and find many uses. One such lock is employed as a lid lock on the Keysafe brand lockbox, marketed by the present assignee and described in U.S. Pat. No. 4,936,894 and in allowed U.S. Pat. No. 5,768,921 (incorporated herein by reference).

The patented lock includes plural elongated buttons, each of which has, on the sides thereof, plural cut-outs, or "gates." A case contains the lock and defines plural bores within which the buttons travel. The buttons are urged out a front cover of the case (i.e. towards the user) by biasing springs. Plural latching members cooperate with features on the buttons to hold same in a depressed position against the force of the biasing springs when the buttons are pushed in by an operator of the lock.

The lock further includes a locking bolt which is coupled to a checker plate. The checker plate defines plural edges that engage the sides of the buttons and are received in the gates therein if the buttons are properly positioned. The checker plate is slidably mounted in a track within the case and is normally urged to a first end of the track by another biasing spring. When the checker is at this first end of its travel, the bolt is in its locked position.

A knob is coupled to the checker plate and can be operated to urge the checker plate towards a second end of its track. However, the checker plate is prevented from moving to the second end of its track if the portions of the buttons engaged by the edges of the checker plate do not include gates.

By the foregoing arrangement, all of the buttons must be properly positioned (in vs. out, and rotationally correct) if the checker plate is to be moved to its second position so as to move the bolt to the unlocking position.

In accordance with a preferred embodiment of the present invention, various enhancements are provided to a pushbutton lock to enhance its security. One enhancement is the provision of button tips which are mounted on the ends of the button assemblies and are spring-loaded to protrude from the face of the lock, regardless of whether the underlying button is "in" or "out." By this arrangement, a bystander cannot readily see the button combination by the pattern of depressed buttons. This arrangement also reduces tactile feedback between the underlying button assembly and the externally available button tips, increasing resistance to pick attacks.

A further enhancement is the provision of button bars between adjacent pairs of button tips. Whenever any of the button tips is manually depressed, the corresponding button bar is pressed into engagement with a corresponding notch in a detent member (called the "centipede" in the issued patent). Such keying of the detent member prevents the lock bolt (more particularly the checker plate connected thereto) from movement. This arrangement further increases lock security by preventing an attacker from experimentally pressing buttons and judging the tactile effect thereon of attempted operations of the unlocking knob.

The foregoing and additional features and advantages of the invention will be more readily apparent from the following detailed description, which proceeds with reference to the accompanying drawings.

BRIEF DESCRIPTION OF THE DRAWINGS

FIG. 1 is a front view of a pushbutton lock according to one embodiment of the present invention.

FIG. 1A is a view of a button assembly used in the lock of FIG. 1.

FIG. 2 is a section view, taken along line 2—2 of FIG. 1 (but omitting the back portion of the lock).

FIG. 3 is a plan view of a checker plate used in the lock of FIG. 1, and its relationship with button bodies.

FIGS. 4A and 4B are views of a pair of button tips connected by a button bar, as used in the lock of FIG. 1.

DETAILED DESCRIPTION

Figure 5:
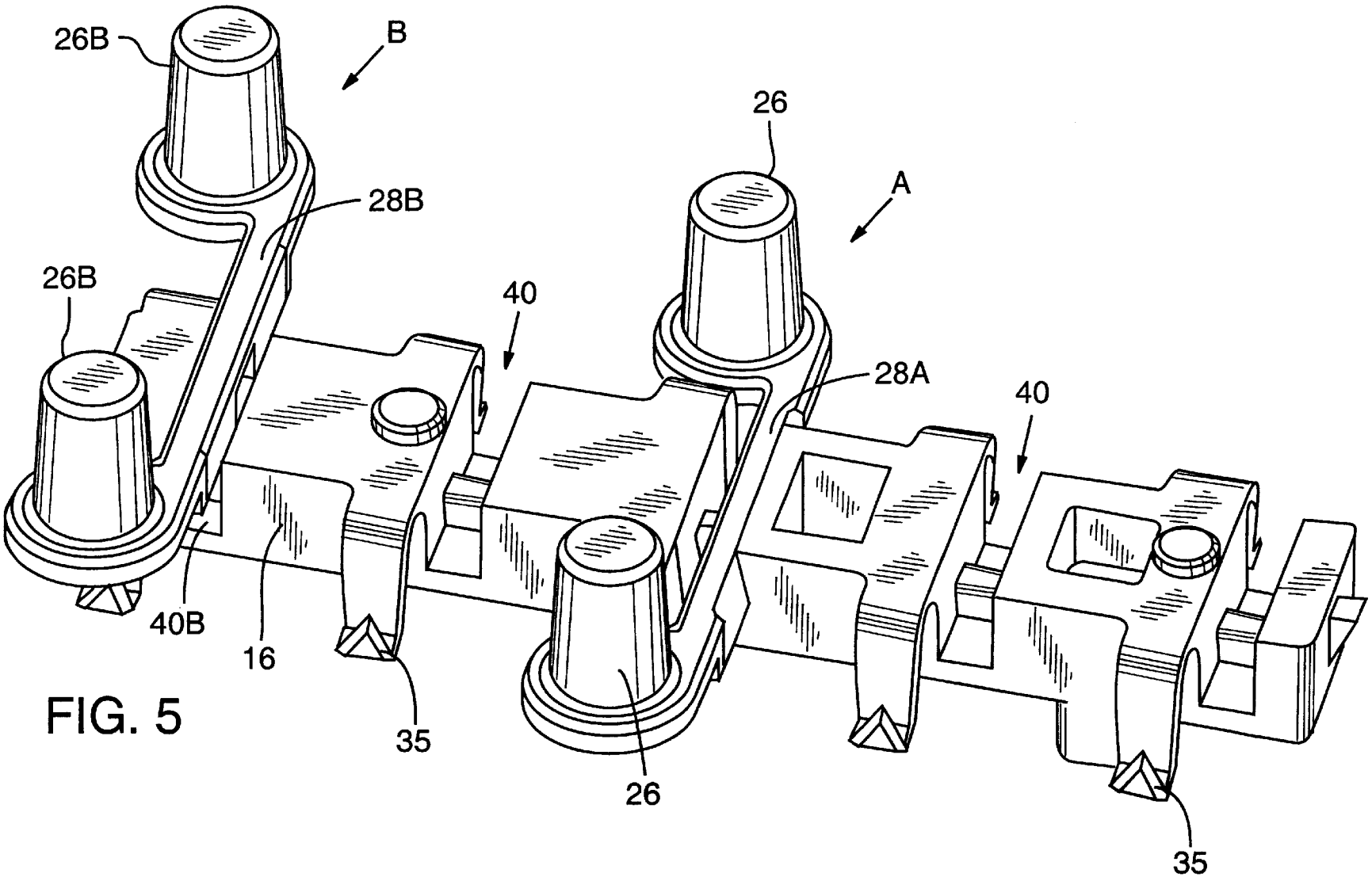
FIG. 5 is a view showing exemplary interaction between a detent member and the button tips and bridges of FIGS. 4A and 4B.

Referring to FIGS. 1–5, an improved pushbutton lock according to one embodiment of the present invention includes a bolt 10, a knob 12, a checker plate 14, a detent 16, and plural button assemblies 18. Each button assembly 18 includes a button body 20, a neck 22, a spring 24, and a button cover or button tip 26. Adjacent pairs of button tips 26 are bridged by a button bar 28 FIGS. 4A and 4B.

As in the prior patent, the button body 20 includes side gates 30A and 30B that can be positioned (or not) to allow corresponding edges 32 of the checker plate to be received therein. In the button assembly shown in FIG. 1A, the button is positioned so that the checker plate edge 32 cannot move downwardly therein. (This could be changed by either pressing the button body down, so gate 30B is facing checker plate edge 32, or by rotating the button body 180 degrees, so that gate 30A is positioned to receive checker plate edge 32.)

Spring 24 serves to bias the button tip 26 up, away from the button body 20 and out the face of the lock. The button tip is held within the body of the lock by a lip 34. When a user presses button 26, spring 24 is first compressed. When the spring is fully compressed, the button tip presses down on the button body 20. Using structures shown in the issued patent (including the triangular nibs 35 in FIG. 5), this action serves to latch the button body into its "pressed" position (in this case, positioning gate 30B to receive edge 32 of the checker plate 14). Releasing pressure on the button tip 26 allows spring 24 to again push the tip away from the button body and out the face of the lock.

As described in the issued patent, bolt 10 and actuator or knob 12 are both secured to the checker plate 14. Accordingly, if all of the button bodies are oriented so that they have gates 30 facing edges 32 of the checker plate 14, knob 12 can be moved downwardly to retract bolt 10. In contrast, if any of the buttons is not correctly positioned, then the checker plate 14, and the knob and bolt, are restricted in their movement and the lock cannot be opened.

When checker plate 14 moves during an unlocking operation, it also causes detent 16 to move. The coupling between these elements is effected by a shoulder 36 that extends from the detent and engages an end 38 of the checker plate. If the detent 16 is prevented from movement, so too will be the checker plate, the knob, and the bolt. This is the purpose served by the button bars 28.

Springs 24 normally keep the button tips 26, and the button bars 28 therebetween, pushed away from the detent 16. However, if a button tip is pressed-even slightly, the button bar linked to that button tip (i.e., a first member) will be pushed into engagement with a notch 40 in the detent 16 (i.e., a second member). This engagement serves to key the detent in place, preventing its movement. Accordingly, the knob and bolt are locked against movement if any of the button tips is depressed during operation.

FIG. 5, at "A" shows a button bar 28A engaged with a notch 40. In contrast, "B" shows a button bar 28B in its normal position, out of engagement with a notch 40B. As can be seen from "B," a very slight downward motion of either button tip 26B will serve to press button bar 28B into the notch 40B.

From the foregoing, it will be recognized that the illustrated structure provides several deterrents against attack. The button tips 26 isolate the user from the button body 20, reducing the amount of tactile feedback available to an attacker. Similarly, the button bars 28 assure that an attacker cannot gain any tactile feedback by trying to operate the lock while pressing on different buttons; pressure on any button freezes the checker plate 14 from moving relative to the button bodies.

Having described and illustrated the principles of my invention with reference to a preferred embodiment, it should be apparent to those skilled in the art that the embodiment can be modified in arrangement and detail without departing from such principles. Accordingly, I claim as my invention all such modifications as may come within the scope and spirit of the following claims and equivalents thereto.

What is claimed is:

1. In a pushbutton combination lock, a mechanism for minimizing tactile feedback to a user attempting to determine a combination that unlocks the lock, the mechanism comprising:

a bolt movable in a first direction to unlock the lock;

a detent member that is coupled to and moves with the bolt, the detent member having a series of spaced notches;

a check plate positioned adjacent the detent member; and plural buttons each movable in a second direction approximately perpendicular to the first direction, each button being movable between at least a first normal position and a second depressed position, each button having an attached blocking member that is attached to and moves with the button, the blocking member being shaped to engage one of the notches in the detent member, wherein depressing one of the buttons from the normal position to the depressed position engages the blocking member attached to the button with an adjacent one of the notches in the detent member, thereby limiting movement of the detent member and the coupled bolt in the first direction.

2. The lock of claim 1, wherein the buttons are arranged in two parallel rows, and wherein the blocking number of each button in a first of the two rows is attached to a respective blocking member of an adjacent button in a second of the two rows.

3. The lock of claim 1, further comprising a knob attached to the bolt, and wherein the bolt is not capable of movement in the first direction when at least one of the buttons is in a depressed position and the knob is urged in the first direction.

4. The lock of claim 1, wherein the blocking member is a button bar.

5. In a pushbutton combination lock, a mechanism for minimizing tactile feedback to a user attempting to determine a combination that unlocks the lock, the mechanism comprising:

a bolt movable in a first direction to unlock the lock;

a detent member that is coupled to and moves with the bolt, the detent member having a series of spaced notches; and plural buttons each movable in a second direction approximately perpendicular to the first direction, each button being movable between at least a first normal position and a second depressed position, each button having an attached blocking member that is attached to and moves with the button, the blocking member being shaped to engage one of the notches in the detent member, wherein moving the bolt and the detent member in the first direction prevents any of the buttons from being depressed from the first position to the second position, and wherein depressing one of the buttons from the normal position to the depressed position engages the blocking member attached to the button with an adjacent one of the notches in the detent member, thereby limiting movement of the detent member and the coupled bolt in the first direction.

6. The lock of claim 5, wherein an attempt to depress one of the buttons from the first position to the second position is blocked by contact between the button and the detent member.

7. The lock of claim 5, wherein the buttons are arranged in two parallel rows, and wherein the blocking number of each button in a first of the two rows is attached to a respective blocking member of an adjacent button in a second of the two rows.

8. The lock of claim 5, further comprising a knob attached to the bolt, and wherein the bolt is not capable of movement in the first direction when at least one of the buttons is in a depressed position and the knob is urged in the first direction.

9. The lock of claim 5, further comprising a checker plate positioned adjacent the detent member.

10. The lock of claim 5, wherein the blocking member is a button bar.

* * * * *

UNITED STATES PATENT AND TRADEMARK OFFICE

CERTIFICATE OF CORRECTION

PATENT NO. : 6,272,889 B1 
DATED : August 14, 2001
INVENTOR(S) : Charles E. Burleigh and Wayne F. Larson It is certified that error appears in the above-identified patent and that said Letters Patent is hereby corrected as shown below:

Title page,
Item [56], References Cited, please delete "LArson" and insert -- Larson --.

Signed and Sealed this

Eleventh Day of February, 2003

JAMES E. ROGAN
*Director of the United States Patent and Trademark Office*